United States Patent [19]

Irgens

[11] 3,938,458

[45] Feb. 17, 1976

[54] ADJUSTABLE BOAT HULL

[75] Inventor: Finn T. Irgens, Wauwatosa, Wis.

[73] Assignee: Outboard Marine Corporation, Waukegan, Ill.

[22] Filed: Dec. 23, 1974

[21] Appl. No.: 536,000

[52] U.S. Cl. ..... 114/66.5 P; 114/106

[51] Int. Cl.[2] ..... B63B 1/22

[58] Field of Search ..... 114/66.5 P, 39, 89, 91, 114/97, 98, 102, 104–107

[56] References Cited

UNITED STATES PATENTS

| | | | |
|---|---|---|---|
| 383,172 | 5/1888 | Crandall | 114/97 |
| 3,026,839 | 3/1962 | Fridge | 114/66.5 P |
| 3,159,131 | 12/1964 | Frederick | 114/66.5 P |
| 3,194,202 | 7/1965 | Saunders | 114/106 |
| 3,285,215 | 11/1966 | Potter | 114/106 |
| 3,435,795 | 4/1969 | Eckfield | 114/66.5 P |
| 3,678,874 | 7/1972 | Flink | 114/66.5 P |
| 3,749,043 | 7/1973 | Crall | 114/106 |

*Primary Examiner*—Trygve M. Blix
*Assistant Examiner*—Stuart M. Goldstein
*Attorney, Agent, or Firm*—Michael, Best & Friedrich

[57] ABSTRACT

Disclosed herein is a boat including a hull comprising a bottom surface including a panel having leading and trailing edges, together with forward and rearward bottom surface portions adjacent to the leading and trailing edges of the panel. Also included in the boat hull is structure pivotally mounting the panel to the boat hull forwardly of the stern of the boat hull for movement about a transverse axis between a first position wherein the leading and trailing edges of the panel merge with the forward and rearward portions of the bottom surface and a second position wherein the panel leading edge merges with the forward portion of the bottom surface and the panel trailing edge is spaced below the rearward portion of the bottom surface, together with means for pivotally displacing the panel between the positions.

The boat also includes a mast fixedly extending upwardly from the hull, an elongated spar, a rotatable eye and hook arrangement mounting the spar from the hull for pivotal movement about an axis extending lengthwise of the spar and for pivotal movement about a general horizontal axis between an upwardly extending raised position in generally parallel relation to the mast and a lowered position adjacent to the hull, a rigging connected to the mast for raising and lowering the spar between the raised and lowered positions, a sail connected to the spar, and rigging for rotating the spar to furl the sail thereon when the spar is in the raised position.

6 Claims, 6 Drawing Figures

63
61
4
103
109
77
75
11
4
101
97
71
73
103
101
69
65
125
123
91
67
53
6
5
51
95
81
93
52
121
41
83
79
43
49
45
15
21
17
131
13
47
6
5

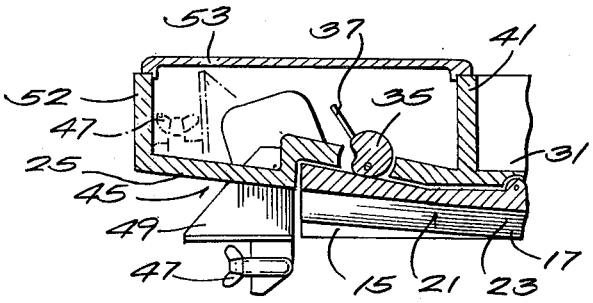
Fig. 2.
Fig. 3
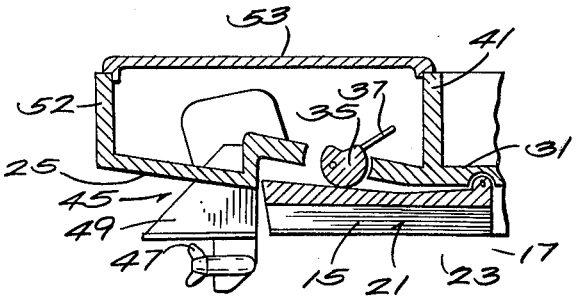
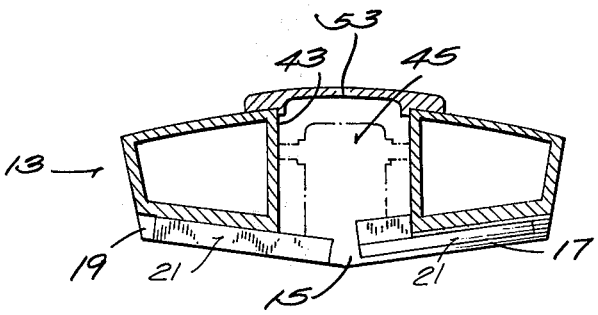
Fig. 6
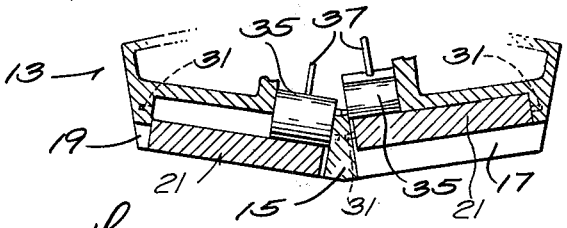
Fig. 5
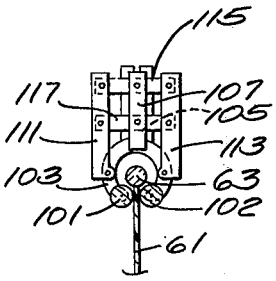
Fig. 4

ADJUSTABLE BOAT HULL

BACKGROUND OF THE INVENTION

The invention relates generally to boat hulls and, more particularly, to sail boat hulls and to power boat hulls.

The invention also relates to sail boat rigging.

SUMMARY OF THE INVENTION

The invention provides a boat including a hull comprising a bottom surface including a panel having leading and trailing edges and forward and rearward bottom surface portions adjacent to the leading and trailing edges of the panel, together with means pivotally mounting the panel to the boat hull forwardly of the stern of the boat hull for movement about a transverse axis between a first position wherein the leading and trailing edges of the panel merge with the forward and rearward portions of the bottom surface and a second position wherein the panel leading edge merges with the forward portion of the bottom surface and the panel trailing edge is spaced below the rearward portion of the bottom surface, and means for pivotally displacing the panel between the positons. Thus, when the panel is in the first position, the bottom surface of the boat hull extends smoothly to provide a sailing hull and when the panel is in the second position, the panel forms at least a part of a planing surface.

In one embodiment in accordance with the invention, the panel is pivotally connected adjacent to the leading edge thereof to the boat hull. Also in accordance with the invention, the boat hull includes a fore and aft center line and the panel is located to one side of the center line and the boat hull further includes a second panel mounted in like manner to the first panel on the other side of the center line.

The invention also provides a boat including a mast fixedly extending upwardly from a hull, an elongated spar, means mounting the spar from the hull for pivotal movement about an axis extending lengthwise of the spar and for pivotal movement about a general horizontal axis between an upwardly extending raised position in generally parallel relation to the mast and a lowered position adjacent to the hull, together with means connected to the mast for raising and lowering the spar between the raised and lowered positions, a sail connected to the spar, and means for rotating the spar to furl the sail thereon when the spar is in the raised position.

In one embodiment in accordance with the invention, there is additionally provided means associated with the spar and removably connected to the mast for guiding furling of the sail on the spar.

The movable panel feature and the spar arrangement are preferably used together although the invention is not so limited.

One of the principal features of the invention is provision of a boat including a hull which can be selectively arranged for sail boating and for power boating.

Another of the principal features of the invention is the provision of a boat including a spar which can be pivoted about a transverse horizontal axis to move the spar between raised and lowered positions and which, when in the raised position, can be rotated about an axis extending lengthwise of the spar to furl and unfurl a sail connected to the spar.

Another of the principal features of the invention is the provision of a boat as described in the preceding papagraph, and further including means associated with the spar for guiding furling and unfurling of the sail on the spar.

Another of the principal features of the invention is the provision of a boat including, in combination, a hull which can be selectively arranged for sail boating and for power boating, and particularly planing power boating, and a spar which can be pivoted about a transverse horizontal axis between raised and lowered positions and which, when in the raised position, can be rotated about an axis extending lengthwise of the spar to furl and unfurl a sail connected to the spar.

Other features and advantages of the disclosed embodiment of the invention will become known by reference to the following drawings, general description, and claims.

DRAWINGS

FIG. 2 is a fragmentary view partially in section, of one portion of the boat hull shown in FIG. 1.

FIG. 3 is a view similar to FIG. 2 in a different operating position.

FIG. 4 is a view taken generally along line 4—4 of FIG. 1.

FIG. 5 is a sectional view taken generally along line 5—5 of FIG. 1 with the left-hand portion thereof corresponding to the arrangement shown in FIG. 3 and with the righthand portion thereof corresponding to the arrangement shown in FIG. 2.

FIG. 6 is a fragmentary sectional view taken generally along line 6—6 of FIG. 1 with the left-hand portion thereof corresponding to the arrangement shown in FIG. 3 and with the righthand portion thereof corresponding to the arrangement shown in FIG. 2.

Figure 1:
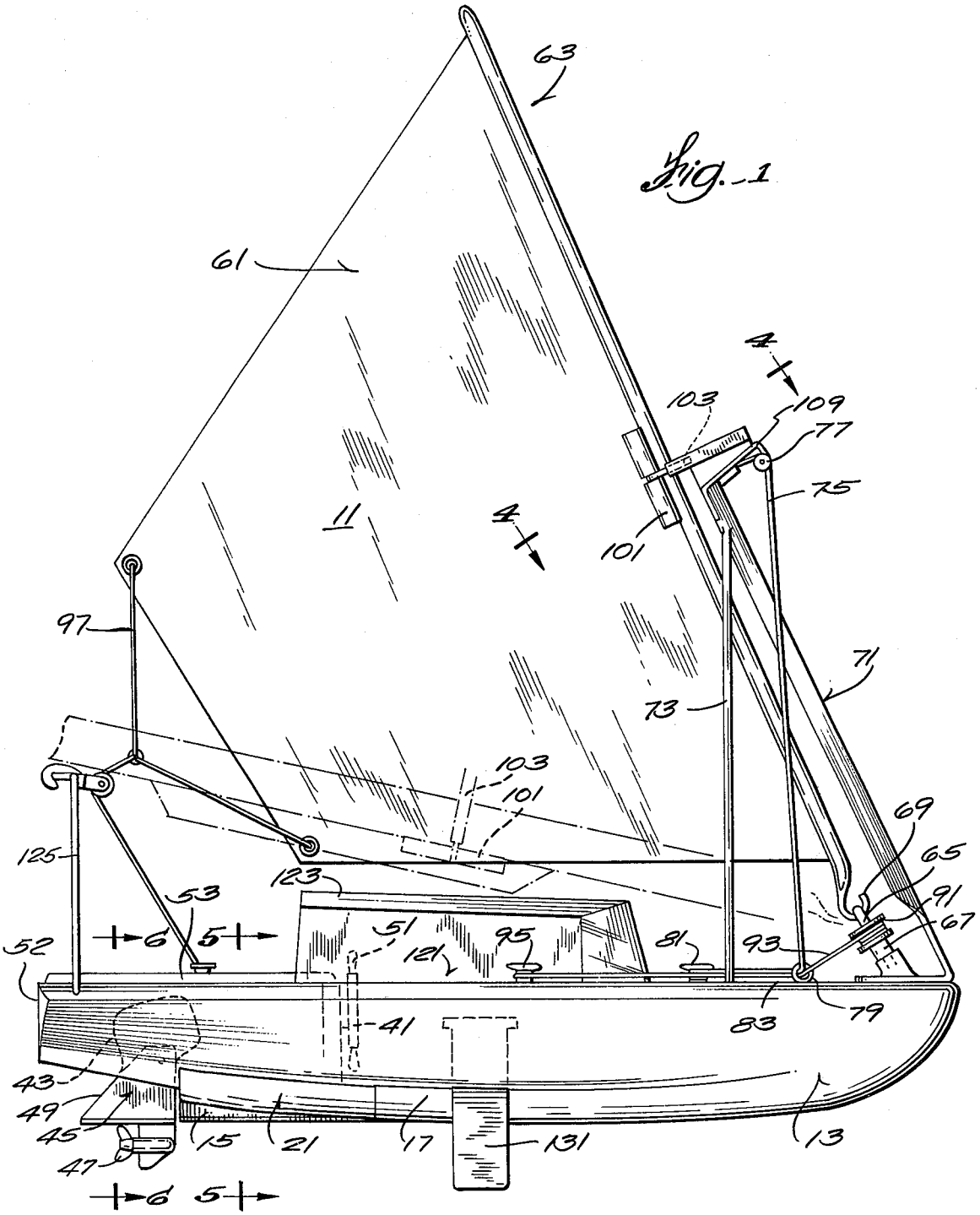
FIG. 1 is a side elevational view of a boat embodying various of the features of the invention.

Before explaining the boat in detail, it is to be understood that the invention is not limited in its application to the details of construction and the arrangement of the components set forth in the following description or illustrated in the drawings. The invention is capable of other embodiments and of being practiced and carried out in various ways. Also it is to be understood that the phraseology and terminology employed herein is for purpose of description and should not be regarded as limiting.

GENERAL DESCRIPTION

Shown in the drawings is a boat 11 which can be effectively operated as either a sail boat or as a motor or power boat. In this regard, the boat 11 includes a hull 13 with a V-bottom formed, in part, by a center keel 15 (See FIGS. 5 and 6) and a pair of laterally extending bottom surfaces 17 and 19 which extend outwardly and upwardly from the fore and aft center line or keel 15.

Each of the bottom surfaces 17 and 19 respectively includes a part or panel 21 which includes a generally planar under surface and which, adjacent its leading edge, is movably mounted about a transverse axis to the adjacent margin of the associated one of the bottom surfaces 17 and 19.

The parts or panels 21 are respectively movable between a first or raised position (See FIGS. 2 and the right-hand portions of FIGS. 5 and 6) in which their leading and trailing edges respectively merge smoothly with the adjacent forward and rearward portions 23 and 25 respectively of the respective bottom surfaces 17 and 19 so as to provide a continuously smooth "sailing" hull, and a second or lowered position (See FIGS. 3 and the left-hand portion of FIGS. 5 and 6) wherein the leading edges of the movable panels or parts 21 merge smoothly with the forward portions 23 of the bottom surfaces 17 and 19 and wherein the trailing edges of the movable panels 21 are spaced downwardly from the rearward portions 25 of the bottom surfaces 17 and 19 so as to provide a "planing" hull particularly adapted for power boating.

Any suitable means can be employed to mount the bottom surface panels 21 and to displace the panels 21 between their respective positions. In the construction illustrated in FIGS. 2 and 3, laterally extending trunions or shafts 31 extend from the panels 21 into the laterally adjacent portions of the boat hull 13. In addition, respective cams 35 are mounted for rotation about respective axis parallel to the axis provided by the trunions 31 and between respective positions corresponding to the raised and lowered positions of the bottom panels 21. Fixed to the cams 35 are respective levers 37, whereby the cams 35 can be rotated so as to disperse the panels 21 to the lowered positions and so as to permit movement of the panels 21 to their raised positions in response to movement of the hull through the water or otherwise.

Any other suitable mechanical, hydraulic, or other system can be employed for selectively raising and lowering the bottom panels 21 relative to the bottom surfaces 17 and 19.

Forwardly of the cams 35, the hull 13 includes a transverse water tight bulkhead 41. Aft the movable panels, the hull 13 includes a central slot 43 (See FIGS. 1 and 6) to facilitate mounting about a horizontal axis of a marine propulsion device 45 which can be an inboard installation or preferrably an outboard motor which can be raised out of the water or can be retained in the water with the drive in neutral to permit free wheeling of a propeller 47. If desired, means can be employed for measuring the rate of free wheeling propeller rotation to provide a navigational tool.

If desired, the marine propulsion device can be steerably mounted. If desired, a rudder 49 can be steerably mounted on the propulsion device aft of the propeller 47 to facilitate steering. Located forwardly of the partition or bulkhead 41 is a steering wheel or tilter 51 which can be operably connected to a steerable part of the marine propulsion device 45 or to the tiller 49 to control steering.

Of course, when the boat 11 is power driven by the propulsion device 45, the propulsion device is located in lowered position with the propeller 47 in the water.

For esthetic purposes, the stern 52 of the boat can extend across the central slot 43 to provide an uninterrupted stern. In addition, the central slot 43 can be provided with a removable hatch 53.

When in use as a sail boat, there is provided a main sail 61 extending from an elongated spar 63 which is mounted from the forward part of the hull 13 for rotation about an axis extending lengthwise of the mast and for swinging movement about a horizontal axis between a lowered, generally horizontal storage position shown in dotted outline in FIG. 1 and a raised position shown in full lines FIG. 1. While other constructions could be employed, in the illustrated construction, the spar mounting means comprises an eye 65 which extends from a stud 67 rotatably mounted in the bow of the hull 13 and a hook 69 which extends from the bottom of the spar 63 and passes through the eye 65, thus affording both rotation of the spar 63 and swinging movement of the spar 63 about a horizontal axis between the raised and lowered positions.

The spar 63 is maintained in the raised position by a fixed mast 71 which extends upwardly and rearwardly from the bow of the boat 11 and which can be braced by a laterally spaced pair of stays 73.

The spar 63 is raised and lowered relative to the raised position in generally parallel relation to the mast 71 by a line 75 which is operably attached (through a guiding and furling means still to be described) to a central portion of the spar 63. The line 75 extends through or around a pulley or guide 77 at the top of the mast 71 and through an eye or guide 79 adjacent to the bow of the boat 11 to a rearwardly located cleat 81 on the top deck 83.

Means are provided for rotating the spar 63 to furl and unfurl the sail 61 when the spar 63 is in the raised position. While other constructions could be employed, in the illustrated construction, such means comprises a pulley or reel 91 mounted on the rotatable stud 67 and a line 93 which is fixed to the reel 91 and which extends aft through an eye or guide (which can be the eye or guide 79) to a rearwardly located cleat 95 on the top deck 83. When the sail 61 is unfurled from the spar 63, the line 93 is fully wound upon the reel 91 and thus, withdrawal of the line 93 from the reel 91 causes the spar 63 to rotate and to furl the sail 61.

Pulling rearwardly on one or more lines 97 connected to the rearward end of the sail 61 unfurls the sail 61 with consequent rotation of the spar 63 and rewinding of the line 93 on the reel 91.

Means are provided for guiding furling and unfurling of the sail 61 on the spar 63. While other arrangements can be employed, in the illustrated construction, such means comprises (as shown best in FIG. 4) a pair of rollers 101 and 102 which are mounted for rotation about spaced axes extending parallel to the spar 63. More specifically, the rollers 101 and 102 are located aft of the spar 63 and on each side of the spar 63 on an arcuately extending, rearwardly open element 103 which extends in partially encircling relation to the spar 63 and which is arcuately movable through a slot 105 in the aft end of a support member 107 adapted to be removably connected to a bracket or guide 109 adjacent the top of the mast 71 by any suitable means.

Pivotally connected to the arcuate element 103 on each side of the support member 107 are respective links 111 and 113 which are pivotally connected by spaced fore and aft cross links 115 and 117 which, in turn, are centrally pivotally supported by the support member 107. Thus, when one of the links 111 and 113 moves forwardly, the other of the links 111 and 113 moves rearwardly, and the arcuate element 103 is circumferentially displaced to rock the axes of the rollers 101 and 102 from one side to the other of a fore and aft line extending through the spar 63. It is particularly to be noted, that the sail 61 extends between the rollers 101 and 102 and thus the rollers 101 and 102 serve to guide rolling and unrolling of the sail 61 relative to the spar 63.

Preferably the hull 13 includes a cockpit 121 which can be covered by a top 123 which, preferably, is removable. In addition, rearwardly of the cockpit 121 there is an arch support 125 adapted to support the rearward or upper end of the spar 63 when in lowered or storage position at a height above the cockpit 121 and above the top 123.

In still further addition, the hull 13 is provided with a pair of laterally spaced side boards 131 (only one shown) which can be selectively lowered during sailing operation.

When it is desired to use the boat 11 for sailing, the spar 63 is swung upwardly to its raised position and the sail 61 is unfurled by rearward movement of the lines 97. When it is desired to use the boat 11 as a motor boat, the sail 61 is first furled about the spar 63 by pulling on the line 93 after which, the spar 63 is lowered to the storage position. Thereafter, the panels 21 are displaaced to the lower position and if not already lowered, the marine propulsion device 45 is positioned to place the propeller 47 in the water. The boat 11 is now conditioned for use as a power boat and the panels 21 provide a planing surface.

Various of the features of the invention are set forth in the following claims:

What is claimed is:

1. A boat including a hull comprising a transom, a bottom surface extending forwardly from said transom and including an opening located in forwardly spaced relation from said transom and having leading and trailing edges, a forward bottom surface portion which curves upwardly and forwardly from adjacent to said leading edge of said opening, and a rearward bottom surface portion which curves upwardly and rearwardly to said transom from adjacent to said trailing edge of said opening, a panel having leading and trailing edges, means pivotally mounting said panel to said boat hull for movement relative to said opening about a transverse axis between a first position wherein said leading and trailing edges of said panel merge with said forward and rearward portions of said bottom surface so as to provide a continuously smooth sailing hull, and a second position wherein said panel leading edge merges with said forward portion of said bottom surface and said panel trailing edge is spaced below said rearward portion of said bottom surface so that said panel forms part of a planing surface, and means for pivotally displacing said panel between said positions.

2. A boat in accordance with claim 1 wherein said panel is pivotally connected adjacent to said leading edge thereof to said boat hull.

3. A boat in accordance with claim 1 wherein said boat hull includes a fore and aft center line and said panel is located to one side of said center line and said boat hull further includes a second panel mounted in like manner to said first panel on the other side of said center line.

4. A boat hull in accordance with claim 1 and further including a mast fixedly extending upwardly from said hull, an elongated spar, means mounting said spar from said hull for pivotal movement about an axis extending lengthwise of said spar and for pivotal movement about a general horizontal axis between an upwardly extending raised position in generally parallel relation to said mast and a lowered positon adjacent to said hull, means connected to said mast for raising and lowering said spar between said raised and lowered positions, a sail connected to said spar, and means for rotating said spar to furl said sail thereon when said spar is in the raised position.

5. A boat in accordance with claim 4 and further including means associated with said spar and removably connected to said mast for guiding furling of the sail on said spar.

6. A boat in accordance with claim 4 wherein said mast extends upwardly and rearwardly.

* * * * *